US009945086B2

(12) United States Patent
Sanchez

(10) Patent No.: US 9,945,086 B2
(45) Date of Patent: Apr. 17, 2018

(54) SNOW MELTING DEVICE

(71) Applicant: Jesus Sanchez, North Bergen, NJ (US)

(72) Inventor: Jesus Sanchez, North Bergen, NJ (US)

( * ) Notice: Subject to any disclaimer, the term of this patent is extended or adjusted under 35 U.S.C. 154(b) by 89 days.

(21) Appl. No.: 14/613,680

(22) Filed: Feb. 4, 2015

(65) Prior Publication Data

US 2015/0275449 A1 Oct. 1, 2015

Related U.S. Application Data

(60) Provisional application No. 61/973,476, filed on Apr. 1, 2014.

(51) Int. Cl.
*E01H 5/10* (2006.01)

(52) U.S. Cl.
CPC ..... *E01H 5/102* (2013.01)

(58) Field of Classification Search
None
See application file for complete search history.

(56) References Cited

U.S. PATENT DOCUMENTS 1,160,205 A * 11/1915 Smith ..... E01H 5/102 126/343.5 R
3,155,089 A * 11/1964 Hoyt ..... E01H 5/102 126/343.5 R
4,506,656 A 3/1985 Baasch
4,785,561 A * 11/1988 Swanson ..... E01H 5/104 126/343.5 R
5,235,762 A 8/1993 Brady
5,452,740 A * 9/1995 Bowman ..... E03B 1/04 137/337
5,718,221 A * 2/1998 Lobato ..... E01H 5/102 126/271.1
5,791,335 A * 8/1998 Luciani ..... E01H 5/102 126/343.5 R
5,983,922 A * 11/1999 Laing ..... F04D 13/14 137/337
6,360,738 B1 3/2002 Brooks
6,971,596 B2 * 12/2005 Monroe ..... E01H 5/102 241/23
8,628,324 B2 1/2014 Burnett
2004/0074114 A1 * 4/2004 Rogers ..... E01H 5/106 37/228
2006/0249140 A1 * 11/2006 Bucklew ..... E01H 5/106 126/271.1

(Continued)

*Primary Examiner* — Nathaniel Herzfeld
(74) *Attorney, Agent, or Firm* — Global Intellectual Property Agency, LLC; Jordan Sworen

(57) ABSTRACT

A snow melting device is provided that is suitable for residential or commercial use. The device comprises a wheeled hand cart having a housing that is partitioned into a first portion and a second portion. Snow to be cleared is deposited into the first portion and melted using hot water dispensed from a water circulating system and spray nozzles disposed about the housing periphery. The snow is melted and circulated through the water circulating system, which includes a hot water heater, a water pump, fuel supply reservoirs, a motor to drive the pump, and a water line that communicates heated water from the hot water heater to the nozzles. Snow is melted as it is shoveled into the device, and overflow water exits the housing through drain tubes at a given water level. The device eliminates having to transport or carry snow from an area being cleared.

18 Claims, 3 Drawing Sheets

(56) References Cited

U.S. PATENT DOCUMENTS

| | | | | |
|---|---|---|---|---|
| 2007/0006874 | A1* | 1/2007 | Potter | E01H 5/102<br>126/343.5 R |
| 2008/0276498 | A1* | 11/2008 | Soderberg | E01H 5/102<br>37/197 |
| 2010/0108781 | A1* | 5/2010 | Terrizzi | B08B 3/026<br>239/332 |

* cited by examiner

SNOW MELTING DEVICE

CROSS REFERENCE TO RELATED APPLICATION

This application claims the benefit of U.S. Provisional Application No. 61/973,476 filed on Apr. 1, 2014. The above identified patent application is herein incorporated by reference in its entirety to provide continuity of disclosure.

BACKGROUND OF THE INVENTION

Field of the Invention

The present invention relates to snow melting devices and those that utilize heating elements to melt snow into liquid. More specifically, the present invention relates to a mobile hand cart appliance in which snow is loaded into a hopper and melted into water using a water heater, a heated water circulation system, and a hopper interior that supports snow and water until the water is allowed to evacuate the hopper.

Removing large quantities of fallen snow from a sidewalk or driveway can be a difficult task, particularly if there has been sufficient accumulation that displacing snow in one location and moving it to another location is prohibitive. This is particularly true for long driveways, inner city areas, and in large parking lots. In inner city areas, there is limited space to move the snow, and large piles of accumulated snow must eventually be loaded into vehicles and removed from the city to make space. For large parking lots and long driveways, the distance needed to clear the snow is often great, which requires motorized tools or requires the user to lift and transport the snow to an area away from the location being treated in order to prevent snow accumulation in areas yet to be cleaned.

To deal with this problem, rather than displacing the snow, devices have been developed to melt the snow at a given location. Rather than transporting the snow, the snow is melted into liquid form on the spot. This eliminates an accumulated mass of snow and solves the issue of transporting solid snow from one location to another. These types of devices are generally found in industrial or commercial scale, whereby the assemblies are supported on towed trailers and are sized to receive snow from a front-end loader or similar large capacity loader. For the individual homeowner in a residential environment, this type of apparatus is not attainable and is not practical.

What is needed is a personal snow melting device for homeowners that can be used to melt snow from driveways and sidewalks. The present invention provides such a device, wherein snow can be loaded into a snow melting device embodied in a personal cart, which is suitable for residential or commercial use. The cart comprises a wheeled housing having an open interior and an open upper configured to receive quantities of shoveled snow therein. Along the interior of the device is a water line having a plurality of nozzles, whereby heated water is directed from the water line via the nozzles onto the snow within the housing to melt the same. The snow is melted in the housing and dispensed as a liquid from one or more drain tubes along the housing that remove the melted snow from the housing.

Snow is therefore melted using heated water, and the melted snow is then heated and recycled by the device to melt further snow placed in the device, thereby providing a self-sustaining snow melting apparatus that can be used to melt snow on the spot while shoveling the same. Overall, the present invention allows a user to remove and eliminate snow without carrying or transporting the same from an area being cleared.

Description of the Prior Art

Devices have been disclosed in the prior art that relate to snow melting device. These include devices that have been patented and published in patent application publications. These devices generally relate to large, industrial apparatuses that are suitable for use with front-end loaders and for large scale use. The present invention relates to a personal appliance that can be used equally by residential and commercial users, and with standard shovels and the like. The following is a list of devices deemed most relevant to the present disclosure, which are herein described for the purposes of highlighting and differentiating the unique aspects of the present invention, and further highlighting the drawbacks existing in the prior art.

One such device exemplary of the art is U.S. Pat. No. 6,360,738 to Brooks, which discloses a snow disposal apparatus that comprises a hopper in which snow is deposited and positioned over a plurality of burners for melting the snow. The snow is melted and the resulting water flows through an opening in the bottom of the device. The Brooks device is useful for melting quantities of snow; however it fails to provide a mobile assembly with the elements of the present invention. The present invention contemplates a mobile appliance that circulates heated water through the device to melt snow and deposit heated water into the ambient environment as the device fills.

Similar to Brooks is U.S. Pat. No. 8,628,324 to Burnett, which discloses a burner assembly supported over a hopper for melting snow. The device of Burnett comprises combustion chamber, an engine room, and a receptacle to receive snow. The assembly is sufficiently large that it is positioned on flatbed trailer and used to melt large quantities of snow. By contrast, the present invention contemplates a mobile appliance that resembles a hand cart, whereby a tankless water heater is employed to heat melted snow into water, and pump the heated water over snow placed therein. The device therefore uses the heated snow to melt further snow in a cycle.

U.S. Pat. No. 5,235,762 to Brady discloses another snow melting apparatus that uses a reduction chamber and heated air from a burner to melt snow. A heat exchanger is used, whereby heated water is pumped through pipes and used to melt exposed snow placed within the reduction chamber. Similar to Burnett and Brooks, the Brady device is quite large and is more of a commercial appliance than a personal tool used individually. The elements of the Brady devices similarly diverge from that of the present invention.

U.S. Pat. No. 5,791,335 to Luciani discloses a snow melting device that utilizes a hopper to support snow and direct a spray of water thereon. Further provided is a ram/screen that can collapse on the melting snow and break down the structure thereof. Finally, U.S. Pat. No. 4,506,656 to Baasch discloses an apparatus for liquefying snow using a motor driven agitator and a water source that pumps water continuously into a holding tank. The water source is a hydrant, and the water is removed from the device as it fills to capacity.

As with the aforementioned devices, the Luciani and Baasch devices fail to contemplate a personal appliance that can melt snow at a location being cleared, and one that is not solely used in large-scale commercial or municipal functions. The present invention is a hand cart appliance that receives shoveled snow for melting the same as the snow is loaded. Hot water is circulated through the device to rapidly melt loaded snow, while excess water is removed to maintain an equilibrium between circulated water, melted snow, and snow being loaded to prevent overflow or stoppages.

The present invention contemplates a specific hot water heating system and means of circulating the melted snow as heated water. The heated water is dispensed onto fresh snow loaded into the device, whereby the snow rapidly melts and transforms to water. That water is heated and dispensed over further snow placed therein. The elements and the construction of the present invention are heretofore unanticipated in the art, and it is submitted that a suitable solution to the problem of smaller scale snow melting appliances has yet to be resolved. The present invention substantially diverges in design elements from the prior art and substantially fulfills a need in the art for a personal snow melting appliance.

SUMMARY OF THE INVENTION

In view of the foregoing disadvantages inherent in the known types of snow melting devices now present in the prior art, the present invention provides a new appliance that can be utilized for providing convenience to the user when clearing snow away from an area and melting the same at the location rather than transporting or shoveling the snow.

It is therefore an object of the present invention to provide a new and improved snow melting device that has all of the advantages of the prior art and none of the disadvantages.

It is another object of the present invention to provide a snow melting device is embodied in a mobile appliance suitable for residential or commercial use, and one that can be used with a shovel and not industrial or municipal scale snow clearing devices.

Another object of the present invention is to provide a snow melting device that melts snow being placed therein using heated water, whereby the melted snow byproduct is circulated through the device, heated, and then used to melt further snow placed therein.

Yet another object of the present invention is to provide a snow melting device that employs a tankless water heat and a system that circulates the melted snow, whereby heated water is used to melt snow, the melted snow is heated and used to melt further snow, and overflow water is allow to exit the device via drain tubes.

Another object of the present invention is to provide a snow melting device that employs a wheeled housing having a first interior partition configured to receive snow, and a second interior partition configured to separate the snow from water in the housing, and furthermore allow the snow to evacuate the housing through forward-mounted drain tubes.

Another object of the present invention is to provide a snow melting device that melts snow that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
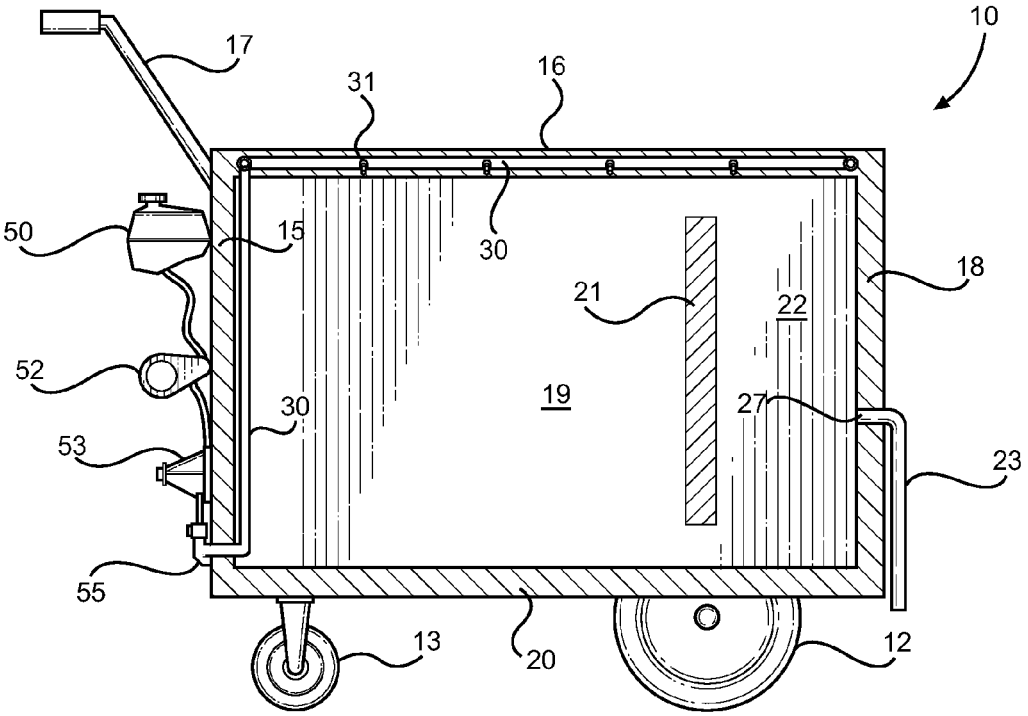
FIG. 1 shows a cross sectional side view of the snow melting device of the present invention.

Reference is made herein to the attached drawings. Like reference numerals are used throughout the drawings to depict like or similar elements of the snow melting device of the present invention. For the purposes of presenting a brief and clear description of the present invention, the preferred embodiment will be discussed as used for melting snow as it is being cleared rather than transporting or carrying the snow to clear an area. The figures are intended for representative purposes only and should not be considered to be limiting in any respect.

Referring now to FIG. 1, there is shown a cross sectional side view of the snow melting device of the present invention. The device comprises a wheeled hand cart device having an open housing 10, a set of wheels 12, 13, and push handles 17 for manually moving the device as snow is cleared. The housing 10 includes a base surface 20, sidewalls, end walls 15, 18, and an open upper 16. The walls of the housing 10 form an open interior volume 19 which is partitioned into a first interior portion 19 and a second interior portion 22. The first interior portion 19 is configured to receive shoveled snow, while the second interior portion 22 fills with water from melted snow and is separated from the more solid snow material. The two interior portions are separated by an internal partition 21, which prevents solid snow from clogging one or more drain tubes 23 or housing outlets 27 disposed along the front wall 18 of the housing 10.

Supporting the housing 10 is first set of roller wheels 12 and a set of caster wheels 13, whereby the roller wheels 12 preferably roll in a single direction, while the caster wheels 13 can roll and rotate to allow the cart to change directions easily. The exact arrangement of the wheels and their construction is not critical to the claimed invention, and any combination or chosen design found suitable for providing a wheeled cart is deemed to fall within the scope of the claimed invention. The handles 17 and the wheels 12, 13 of the cart allow the device to be manually movable and operate as a personal appliance, wherein the device functions as a residential or commercial tool.

Figure 2:
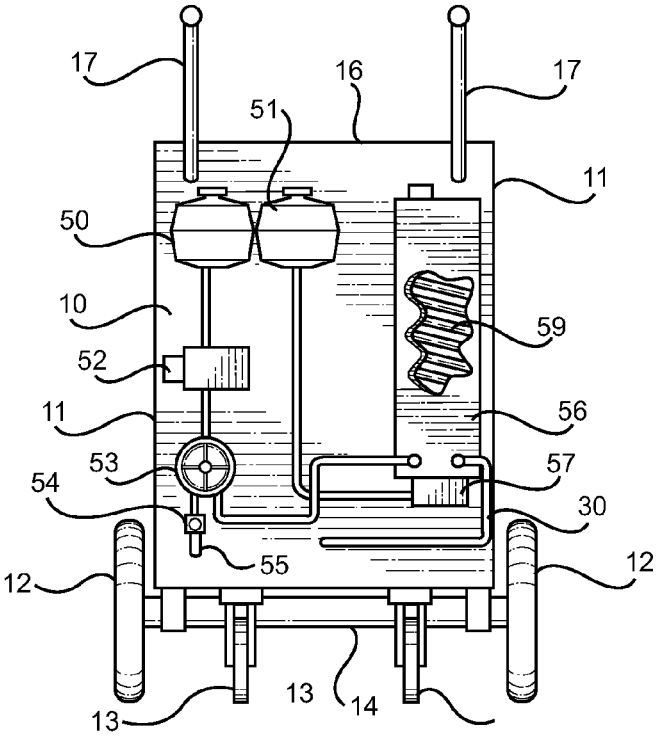
FIG. 2 shows a rear view of the snow melting device of the present invention.

Referring to FIGS. 1 and 2, the water circulation system of the present invention is shown. FIG. 2 shows a view of the snow melting device from the rear wall 15 of the housing 10, whereby the water circulation system and the heating/pumping elements are supported along the exterior of the housing 10. To melt snow placed within the first inner portion 19 of the housing 10, hot water is forced through water lines 30 along the rear and upper periphery of the housing 10, and sprayed onto the solid snow to melt the same. The water lines 30 run from the rear wall 15, up towards the open upper 16 of the housing 10, and around the periphery thereof. High pressure spray nozzles 31 are disposed along the water line 30 along the open upper 16 and spray high pressure, high temperature water therefrom downward onto the snow within the first inner portion 19.

The nozzles 31 are preferably jet nozzles that receive hot water from a tankless hot water heater 56 disposed along the rear wall 15 of the housing 10. The nozzles 13 spray the hot water onto the snow to rapidly melt the same, whereby the water is under significant pressure and the combination of heat and water pressure rapidly act to break down the solid structure of the snow shoveled therein. The snow therefore melts into liquid form and settled within the housing interior. The water circulation system of the present invention recirculates the hot water spray and the newly melted snow into the hot water heater 56 and reapplies it onto new snow placed within the housing, whereby a continuous cycle is repeated. Excess water created is released from drain tubes 23 along the front wall 18 of the housing. The nozzles 31 are disposed along the periphery of the open upper and along the water line 30 leading up to the open upper 16 (i.e. along the vertical and horizontal portions of the water line 30 within the interior of the device).

The water circulation system includes a water inlet 55 that is positioned through the rear wall 15 and receives water collected along the bottom of the housing 10. The water inlet 55 includes a water filter 54 to filter out particulates and protect downstream devices in the system. A water pump 53 pressurizes the water from the inlet 55 and forces it into the tankless water heater 56. The tankless water heater 56 includes a burner 57 or equivalent heat source and a series coils 59 forming an internal heat exchanger that rapidly heats the water pumped therein. The water exits the water heater 56 via its outlet, which leads to the water line 30 that extends into the housing and upwards towards the nozzles 31.

Powering the water pump 53 is a motor 52, which may comprises a fuel burning motor (as shown in the figures) or equivalent motor with a power source (i.e. an electric motor) as an alternative. The preferred configuration utilizes a fuel-burning motor 52 that powers the pump 53 and draws power from combustion of fuel stored within a first fuel tank 50 thereabove. Similarly, the oil burner 57 receives fuel oil from a second fuel tank 51 adjacent to the first fuel tank 50. The water circulation system therefore comprises a water pumping and heating system that draws water from the housing interior (initial water and melted water), pressurizes the water, heats the water, and then directs it through the nozzles 31 back into the housing to melt further snow and ice therein.

Figure 3:
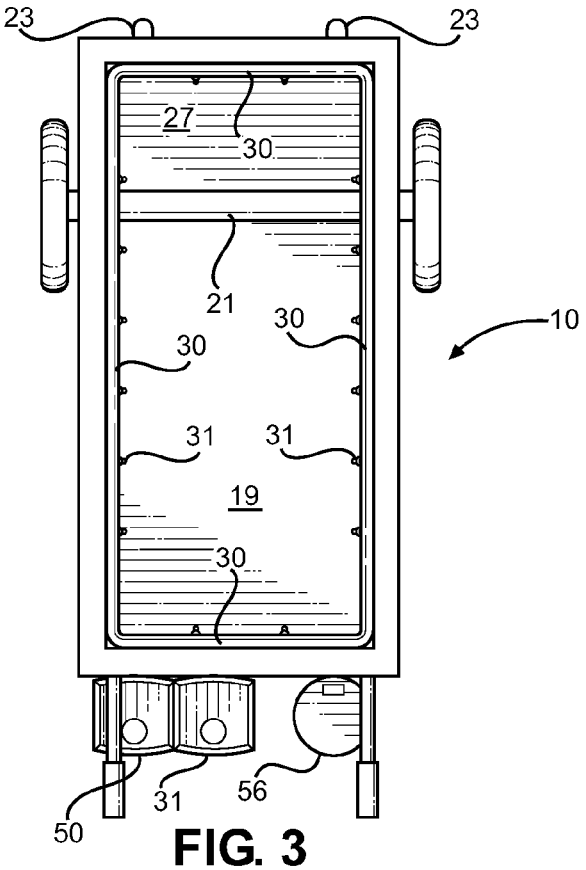
FIG. 3 shows an overhead view of the snow melting device of the present invention.
Figure 4:
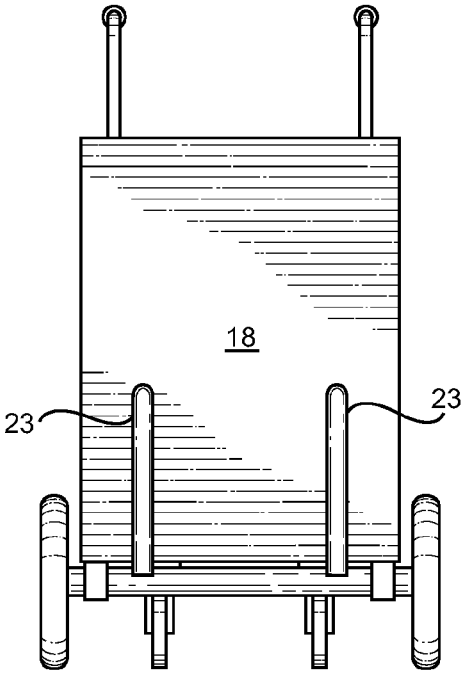
FIG. 4 shows a frontal view of the snow melting device of the present invention.
Figure 5:
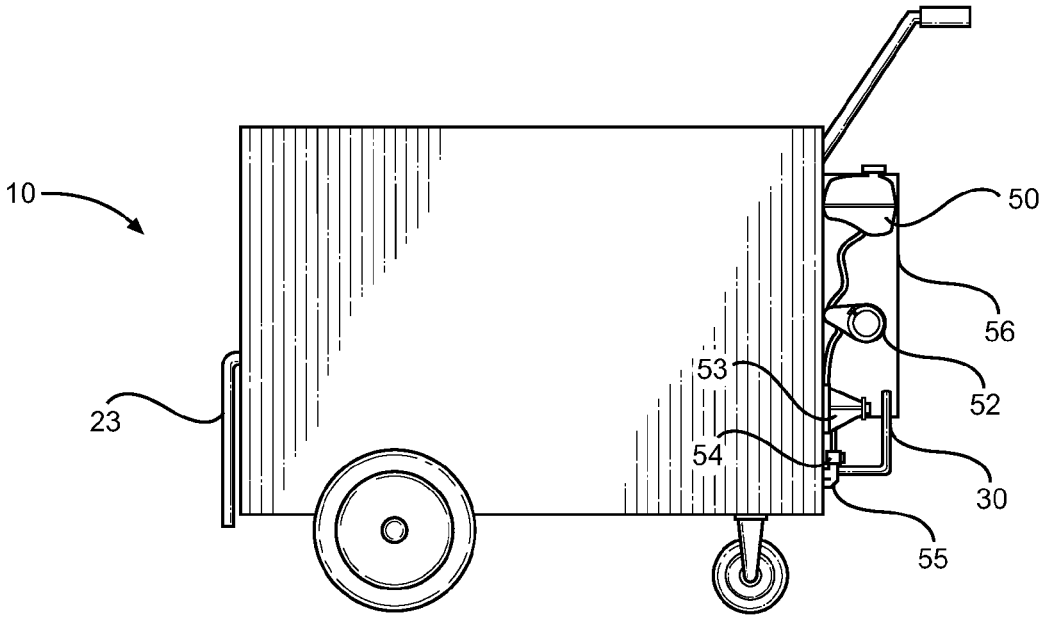
FIG. 5 shows a second side view of the snow melting device of the present invention.

Referring now to FIGS. 3 through 5, there is shown an overhead view, a frontal view, and a side view of the snow melting device of the present invention. The device is wheeled by a user to a location in which snow is being cleared. Rather than transporting quantities of snow during removal, or requiring the user to lift the snow distances while shoveling, the present invention can melt snow and ice at the location. The open upper of the housing 10 receives snow therein, whereby the first inner portion 19 is enlarged and designed to receive snow as it is shoveled therein. The second inner portion 22 is separated from the first inner portion 19 by a partition 21, and separates solid snow and ice from melted water in the housing 10.

To initiate the device, a level of water is placed within the device so that the motor 52 and pump 53 can begin circulating the water, heating the same, and then spraying the water onto snow as it is placed into the housing. The hot water heater 56 and pump 53, powered by fuel stored in a pair of fuel reservoirs 50, 51 or fuel tanks, rapidly heats the circulating water between the inlet 55 and the water line 30 re-entering the housing. The hot water is sprayed onto snow as it is placed into the housing interior. The snow in turn melts, creating more water.

When the housing fills with water, one or more drain tubes 23 are used to allow water to flow therefrom. The drain tubes 23 include an inlet through the front wall 18 of the device and are positioned at a height such that a certain level of water is permitted within the housing before water exits the same. The tubes 23 may be open, or alternatively include a triggered valve that can prevent water from exiting until the water has risen to a more elevated state. This allows the inlets for the tubes 23 to be lower and drain the water more thoroughly, yet be triggered when the water is higher in the housing. This allows more water to be stored therein before requiring draining, which may be a consideration in areas so cold that exiting water may cause ice on the cleared area, and more controlled release of water is desired.

Figure 6:
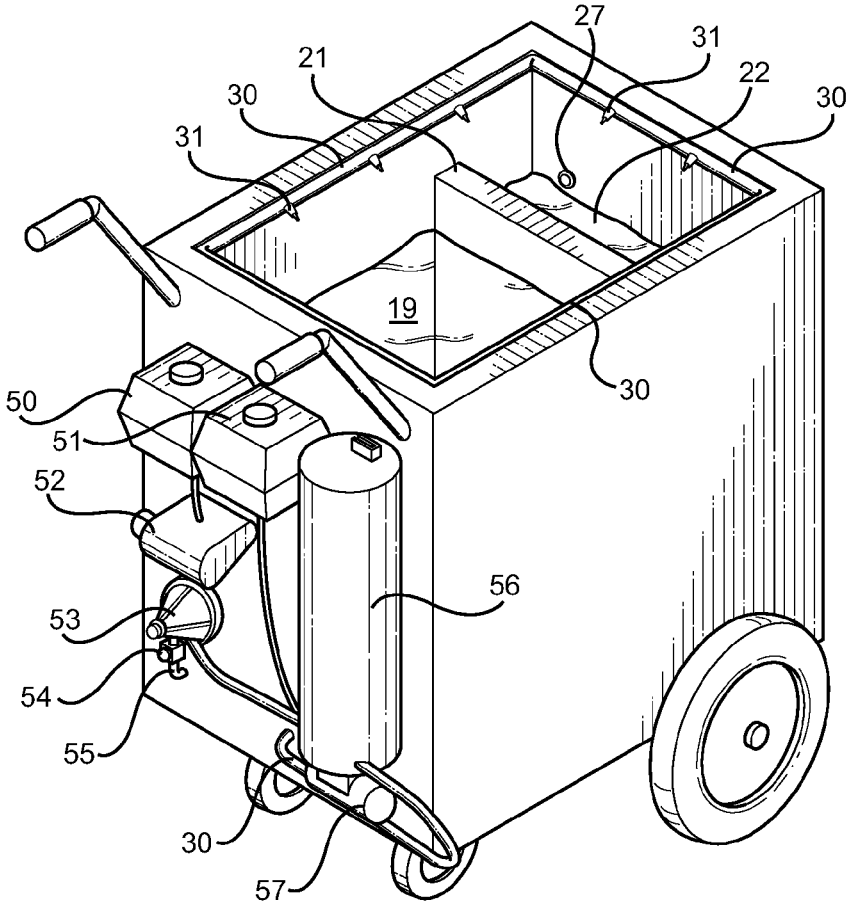
FIG. 6 shows a perspective view of the snow melting device of the present invention in a working state.

Referring finally to FIG. 6, there is shown an overhead perspective view of the snow melting device in a working state. Melted snow and water within the first inner portion 19 is acted upon by hot water being sprayed from the nozzles 31 disposed along the water line 30, which is positioned about the periphery of the housing open upper. Water is drained from the housing interior, which is separated by an internal partition 21 in a first inner portion 19 and second inner portion 22. Water exits the housing via outlets 27 within the second inner portion 22, which may be open or valved, and positioned at a desired height along the front wall of the housing. The water circulation system comprises a water pump 53, a water pump motor 52, a hot water heater 56, a hot water heater burner 57, a water inlet 55 and filter 54, and connection to the water line 30 at the outlet of the hot water heater 57. Fuel for the motor 52 and the hot water heater 56 is supported within fuel tanks 50, 51, respectively. The motor may be driven by gasoline or equivalent, while the hot water heater burner 57 may burn diesel fuel, propane, or similar burning fuel. The second fuel tank 51 fueling the hot water heater 56 may be an open tank, or alternatively a pressurized propane tank, depending upon the design of the system.

It is recognized that it can be very difficult to dispose of snow that accumulates around homes and businesses in driveways, along sidewalks, and other such places since there is inadequate space for the displaced snow. However, if the snow is not removed, then it can gradually compact under its own weight and form a dense, icy conglomeration that takes considerable time to melt. Individuals can use salt or chemicals to melt the accumulated snow, but these materials are not effective for large snow falls and in extremely low temperatures. Therefore, the present invention provides residential and commercial users with a readily deployed appliance to melt snow on-site, whereby transporting the snow or manually carrying the same while shoveling snow from an area is avoided.

The present invention comprises a wheeled cart with an open housing divided into two portions. A water circulating system moves heated water through the housing to melt snow and then recirculate the melted snow until the housing is filled. The snow melts and is drawn into the water circulation system via an inlet and a water pump. The pump drives the water through the hot water heater, which includes a heat exchanger and a burner. The heat exchanger includes steel coil heated by a the burner, which rapidly heats the water prior to be forced into the water lines of the system and sprayed into the housing interior to melt further snow. The heated water then melts additional snow placed within the first portion, creating a continuous loop of recirculated heated water to melt any new snow.

The partition between the first portion and the second portion has an aperture or lower opening to allow the free flow of water between the portions. As more water collects in the housing, the water level in the housing begins to rise. Once the water level in the housing reaches a pre-determined height, the weight of the water exits the drain tubes, either manually or via a triggered valve therein. The valve may be pressure sensitive to open when water pressure above a given height t in the housing is registered, or the valve may be temperature sensitive, releasing water from the housing if the water becomes too cold and may freeze therein. The valve may also be manually controlled by the user. Furthermore, the draining water can either be released through the drain tubes, directly through an outlet in the housing walls, or via an attached water hose that can rout drained water away from the cleared area. As depicted in the figures, the housing is substantially rectangular, however the exact shape and size of the housing make take on several forms, falling within the scope of the claimed invention.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snow melting device, comprising:

a wheeled cart having a housing and a water circulation system;

said housing having a base, sidewalls, an open interior volume and an open upper end, wherein the housing is not divided horizontally;

said water circulation system comprising a water inlet in liquid communication with said interior volume of said housing, a water pump for pumping water from said inlet, through a hot water heater, into an outlet connected to the hot water heater, the outlet also connected to a water line, and into the water line disposed within said interior volume of said housing;

wherein the water line extends along a periphery of the open upper end, with the periphery lying in a plane parallel to the base;

said water line comprising one or more spray nozzles, wherein each of the one or more spray nozzles is disposed along the plane parallel to the base;

said spray nozzles directing pressurized water from said water line and into said interior volume to melt snow and ice therein.

2. The snow melting device of claim 1, wherein: wherein said water pump is powered by a motor.

3. The snow melting device of claim 1, wherein:

wherein said water pump is powered by a fuel-burning motor;

said fuel-burning motor being fueled by a first fuel tank disposed along an exterior of said housing.

4. The snow melting device of claim 1, wherein:

said hot water heater is a tankless hot water heater having a burner heat source, a heat exchanger with coiled water lines therein, and an outlet connecting to said water line.

5. The snow melting device of claim 1, wherein:

said hot water heater is a tankless hot water heater having a burner heat source, a heat exchanger with coiled water lines therein, and an outlet connecting to said water line;

said burner heat source being fueled by a second fuel tank disposed along an exterior of said housing.

6. The snow melting device of claim 1, further comprising a water filter between said water inlet and said water pump.

7. The snow melting device of claim 1, wherein:

said open interior volume of said housing is separated into a first interior portion and a second interior portion by an internal partition;

said first interior portion and said second interior portion being in liquid communication with each other.

8. The snow melting device of claim 1, wherein:

said open interior volume of said housing is separated into a first interior portion and a second interior portion by an internal partition;

said first interior portion and said second interior portion being in liquid communication with each other;

said internal partition configured to prevent solid material in said first interior portion from entering said second interior portion.

9. The snow melting device of claim 1, wherein:

said open interior volume of said housing is separated into a first interior portion and a second interior portion by an internal partition;

said first interior portion and said second interior portion being in liquid communication with each other;

at least one water outlet disposed along said housing and within said second interior portion.

10. The snow melting device of claim 1, further comprising at least one water outlet disposed along said housing configured to allow water to communicate out of said housing.

11. The snow melting device of claim 10, further comprising a drain tube extending from each water outlet.

12. The snow melting device of claim 10, further comprising a valve controlling liquid communication through said water outlet.

13. The snow melting device of claim 12, wherein said valve is a pressure sensitive valve.

14. The snow melting device of claim 12, wherein said valve is a temperate sensitive valve.

15. The snow melting device of claim 1, further comprising one or more handles extending from said housing.

16. The snow melting device of claim 1, wherein:

Said housing further comprises a substantially rectangular structure having a base surface, a pair of sidewalls, a front wall, and a rear wall.

17. The snow melting device of claim 1, wherein the housing is supported by at least one set of wheels configured to roll in a single direction.

18. The snow melting device of claim 1, wherein the housing is supported by at least one set of wheels configured to roll and rotate in a plurality of directions.

* * * * *